US009596883B2

(12) United States Patent
Ahmet

(10) Patent No.: US 9,596,883 B2
(45) Date of Patent: Mar. 21, 2017

(54) SMOKER'S ACCESSORY

(76) Inventor: Ulu Ozturk Ahmet, London (GB)

( * ) Notice: Subject to any disclaimer, the term of this patent is extended or adjusted under 35 U.S.C. 154(b) by 985 days.

(21) Appl. No.: 13/806,167

(22) PCT Filed: Jun. 20, 2011

(86) PCT No.: PCT/GB2011/051147

§ 371 (c)(1),
(2), (4) Date: Feb. 19, 2013

(87) PCT Pub. No.: WO2011/161440

PCT Pub. Date: Dec. 29, 2011

(65) Prior Publication Data

US 2013/0213416 A1 Aug. 22, 2013

(30) Foreign Application Priority Data

Jun. 21, 2010 (GB) ..... 1010372.9

(51) Int. Cl.
*A24F 13/00* (2006.01)
*A45F 5/02* (2006.01)
*A45F 5/00* (2006.01)

(52) U.S. Cl.
CPC ..... *A24F 13/00* (2013.01); *A45F 5/004* (2013.01); *A45F 5/02* (2013.01); *A45F 5/021* (2013.01); *A45F 2200/0566* (2013.01)

(58) Field of Classification Search
CPC ... A45F 5/004; A45F 2200/0566; A24F 13/00
See application file for complete search history.

(56) References Cited

U.S. PATENT DOCUMENTS 4,600,022 A * 7/1986 Pierce, Jr. ..... A24F 13/26 131/243
4,898,532 A * 2/1990 Bercik ..... A45F 5/004 206/86
4,927,354 A * 5/1990 Sanford ..... F23Q 2/34 206/87

(Continued)

FOREIGN PATENT DOCUMENTS

GB WO 9501111 A1 * 1/1995 ..... A45C 13/20

*Primary Examiner* — Mark A Osele
(74) *Attorney, Agent, or Firm* — Milena Sukovic; Sukovic Law PC

(57) ABSTRACT

A device (1) comprising: a base unit (2); an attachment means (15), connected to the base unit, which can be used to attach the base unit (2) releasably to a user's clothing; a leash arrangement comprising a flexible leash (5) element which may be extended from, and retracted into, the base unit (2); and a holder attached to the leash element (5), the holder (9) being operable to grip and release at least one type of cigarette lighter (25,26,27), wherein: the holder (9) comprises first and second arms (11) which protrude away from a central point and are deflected towards one another to present generally opposed gripping surfaces (13); the arms (11) are formed from a resilient material, allowing the arms (11) to deflect to allow a cigarette lighter (25,26,27) to be placed between the arms (11), so the arms (11) will then exert a gripping force on the lighter (25,26,27); and an adjustment arrangement (14) is provided to allow a user to adjust the distance between the gripping surfaces (12) when the holder (9) is in an undisturbed state.

16 Claims, 10 Drawing Sheets

(56) References Cited

U.S. PATENT DOCUMENTS

Figure 1:
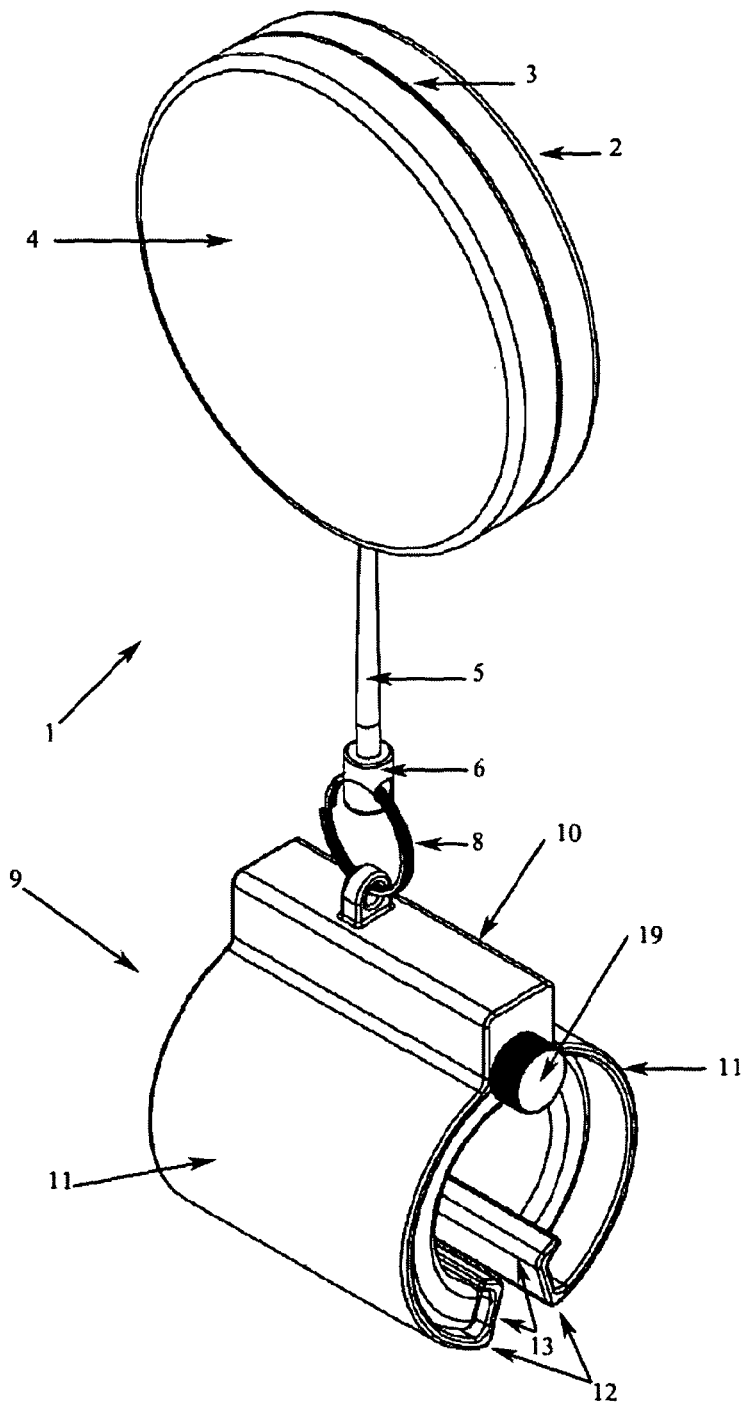

| | | | | | |
|---|---|---|---|---|---|
| 5,026,274 | A * | 6/1991 | Jacob | F23Q 2/34 | 224/162 |
| 6,382,481 | B1 * | 5/2002 | McIlmoil | F23Q 2/32 | 224/162 |
| 6,641,390 | B2 * | 11/2003 | Genuise | A45F 5/004 | 206/87 |
| D516,241 | S * | 2/2006 | Gaines | D27/161 | |
| D518,595 | S * | 4/2006 | Morganfield, Jr. | D27/161 | |
| D546,499 | S * | 7/2007 | Gordon, III | D27/161 | |
| 7,422,170 | B2 * | 9/2008 | Bao | B02C 18/24 | 241/168 |
| D648,891 | S * | 11/2011 | Heger | D27/161 | |
| 8,393,563 | B2 * | 3/2013 | Chaoui | B02C 18/08 | 241/168 |
| 9,265,332 | B2 * | 2/2016 | Zayat | A45F 5/02 | |
| 2002/0085344 | A1 * | 7/2002 | Fields | A45F 5/004 | 361/679.3 |
| 2006/0039740 | A1 * | 2/2006 | Mackay | A45C 11/008 | 401/131 |

* cited by examiner

SMOKER'S ACCESSORY

DESCRIPTION OF INVENTION

The present application relates to a smoker's accessory.

Many people enjoy smoking recreational herbal substances. There are presently several different types of smokers' accessories that are available to help store and organise the various implements and paraphernalia that are required for the preparation of herbal cigarettes. The present invention seeks to provide an improved smoker's accessory.

Accordingly, one aspect of the present invention provides a device comprising: a base unit; an attachment means, connected to the base unit, which can be used to attach the base unit releasably to a user's clothing; a leash arrangement comprising a flexible leash element which may be extended from, and retracted into, the base unit; and a holder attached to the leash element, the holder being operable to grip and release at least one type of cigarette lighter.

Advantageously, the attachment means is attached rotatably with respect to a part of the base unit from which the leash protrudes, so that, if the attachment means is attached to a part of a user's clothing, the part of the base unit may rotate with respect to that part of the user's clothing.

Preferably, the holder comprises first and second arms which protrude away from a central point and are deflected towards one another to present generally opposed gripping surfaces.

Conveniently, the central point comprises a central spine from which the arms protrude.

Advantageously, the arms are formed from a resilient material, allowing the arms to deflect to allow a cigarette lighter to be placed between the arms, so the arms will then exert a gripping force on the lighter.

Preferably, an adjustment arrangement is provided to allow a user to adjust the distance between the gripping surfaces when the holder is in an undisturbed state.

Conveniently, the adjustment arrangement is an adjustment knob which can be rotated by a user.

Advantageously, the device further comprises a grinder, the grinder enclosing a first internal space into which a quantity of a herb can be placed, and have respective first and second grinding arrangements which protrude inwardly into the first internal space, and having a grip arrangement which may be gripped and manipulated by a user so that the sets of grinding arrangements move with respect to one another to apply a grinding action to a quantity of the herb received in the first internal space.

Preferably, one or both of the grinding arrangements is a set of grinding teeth.

Conveniently, the grinder is releasably attachable to the base unit.

Advantageously, the grinder is releasably attached to the base unit by way of respective first and second magnets.

Preferably, the grinder comprises two elements which may rotate with respect to one another, and the grip arrangement comprises respective gripping arrangements formed on outer surface of the two elements.

Conveniently, the grinder comprises a second internal space, separate from the first internal space, and can be opened to gain access to the second internal space.

Advantageously, the sets of grinding arrangements do not protrude into the second internal space.

Preferably, the base unit comprises, or is attached to, a container which substantially encloses an internal space, and can be opened to gain access to the internal space.

Conveniently, the device further comprises a braking mechanism to slow the retraction of the leash into the base unit.

Advantageously, the braking mechanism slows the retraction of the leash into the base unit when a distal end of the leash nears the base unit.

Preferably, the braking mechanism comprises a covering applied over at least a part of the leash.

Figure 2:
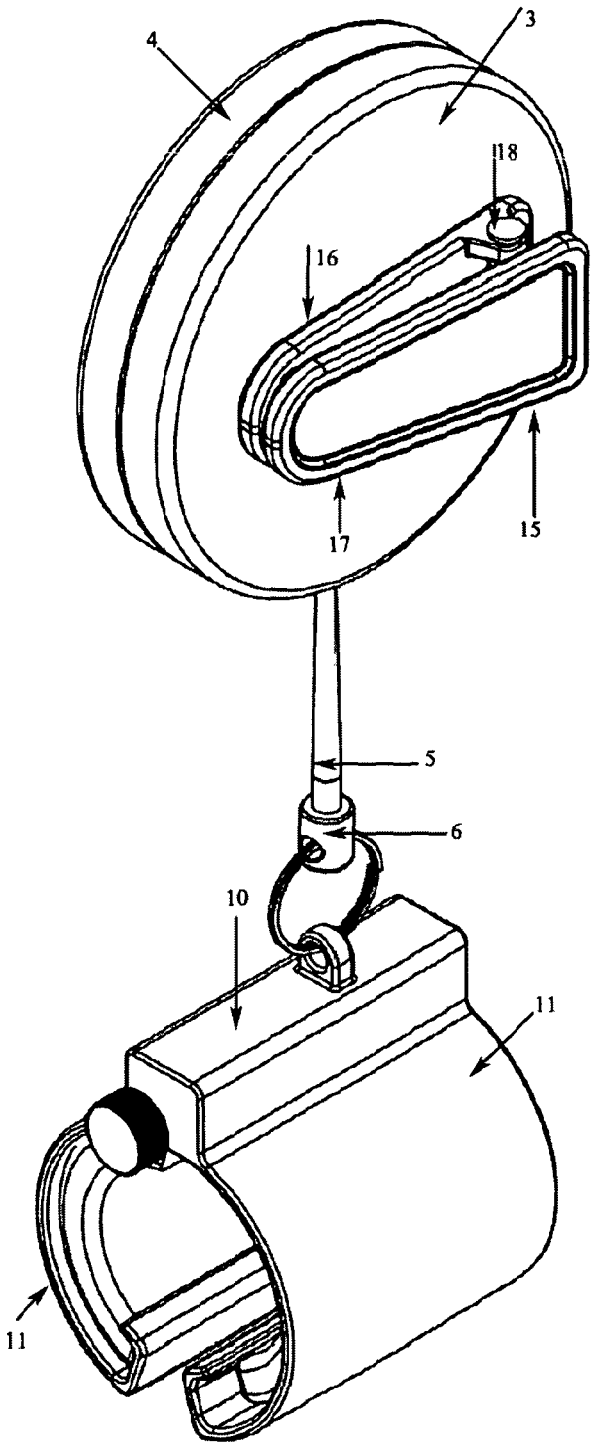
Figure 3:
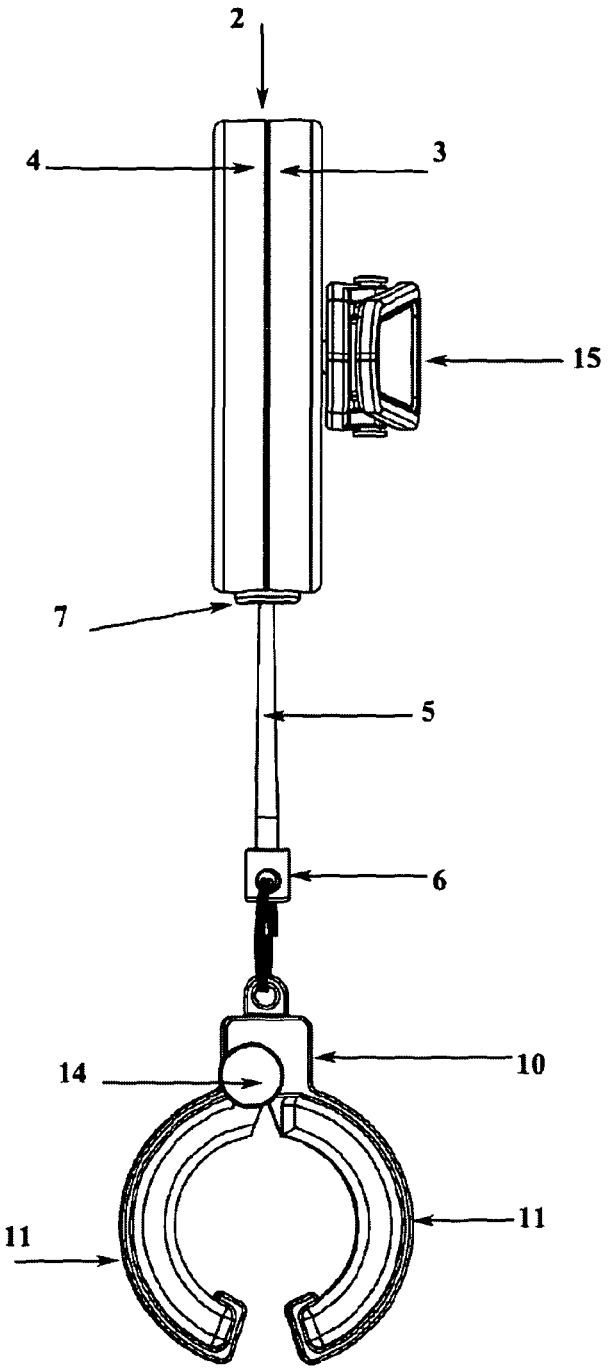
Figure 4A:
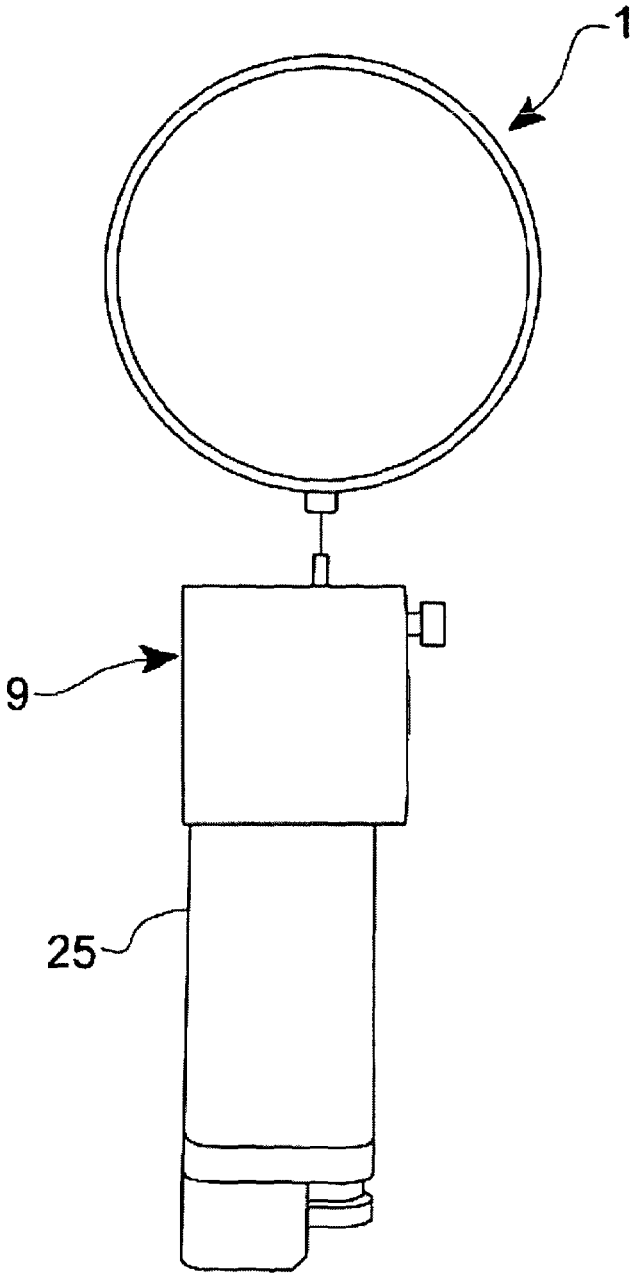
Figure 4B:
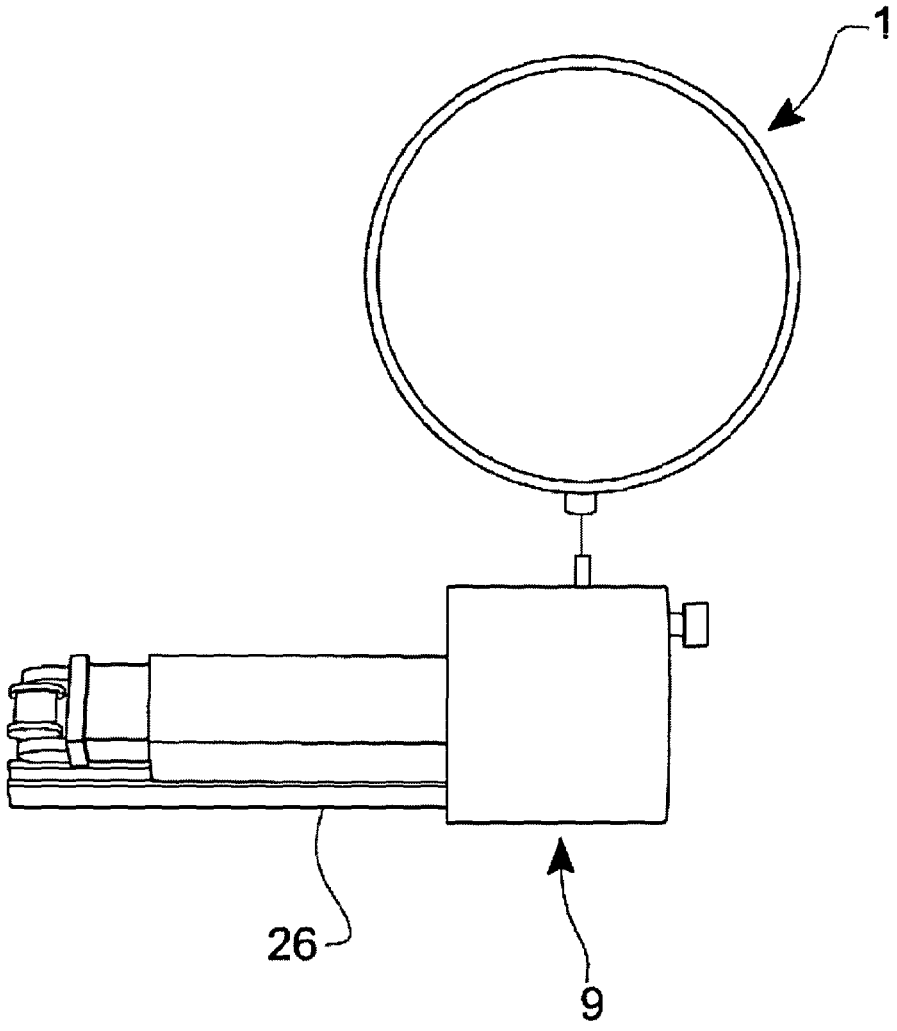
Figure 4C:
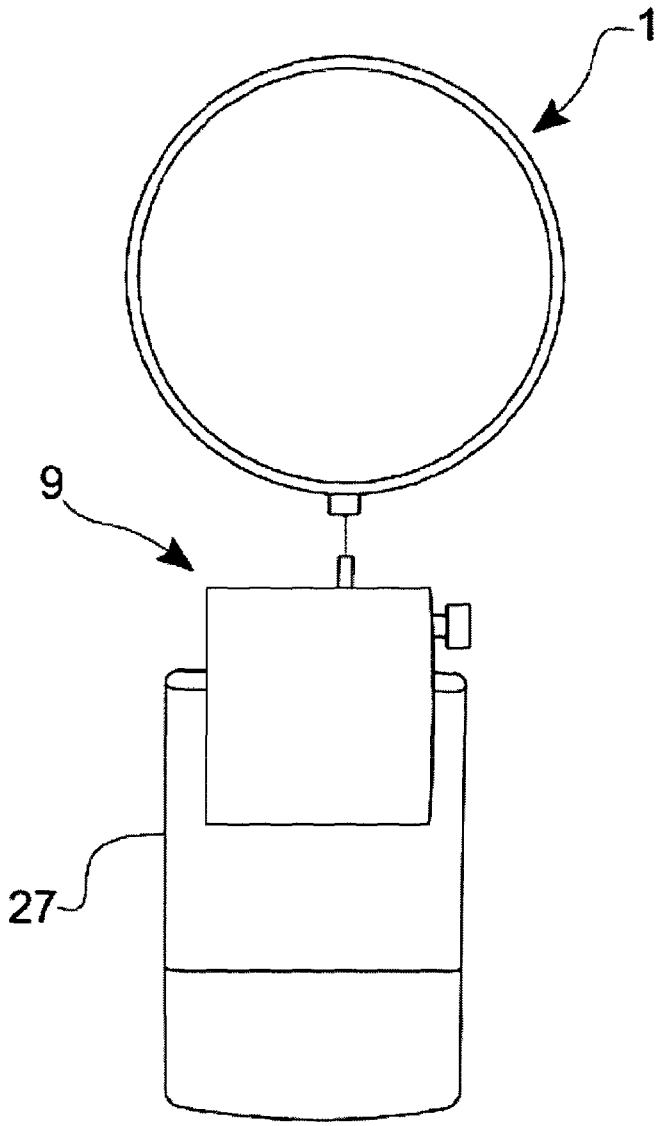
Figure 5:
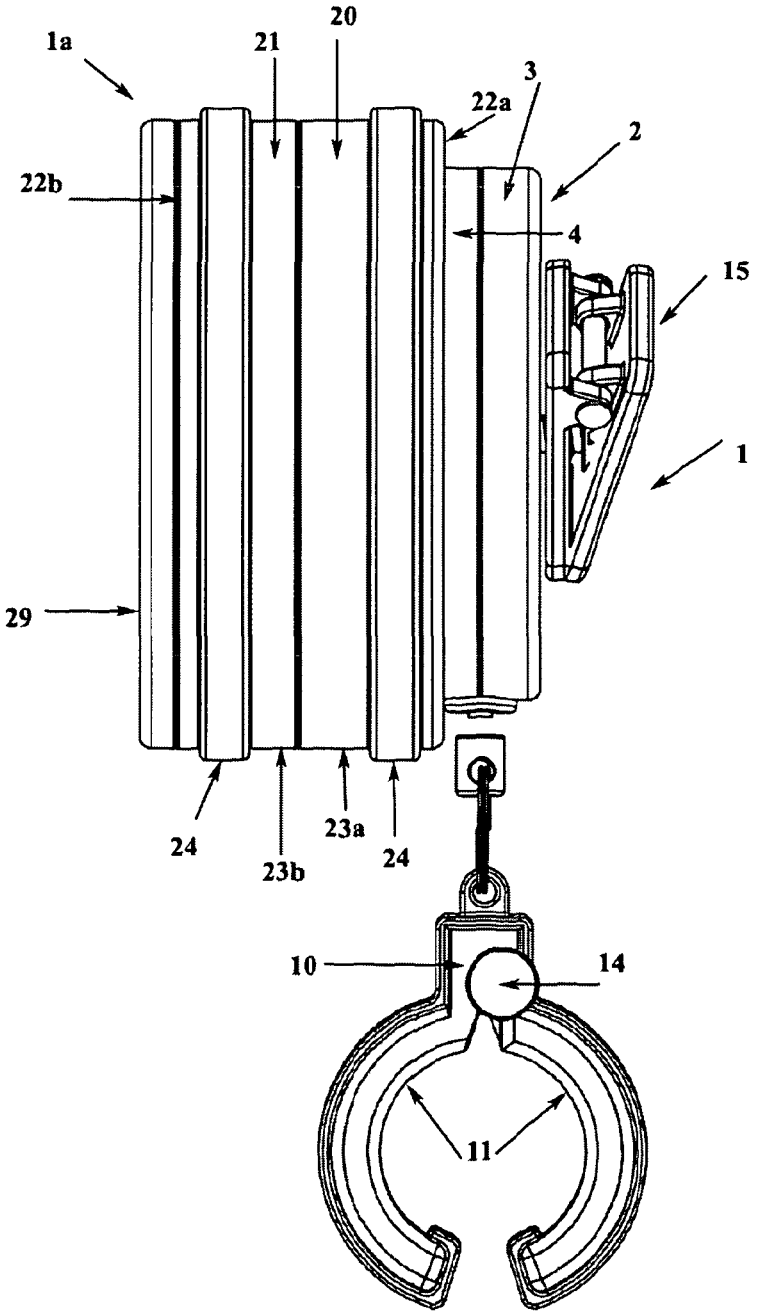
Figure 6:
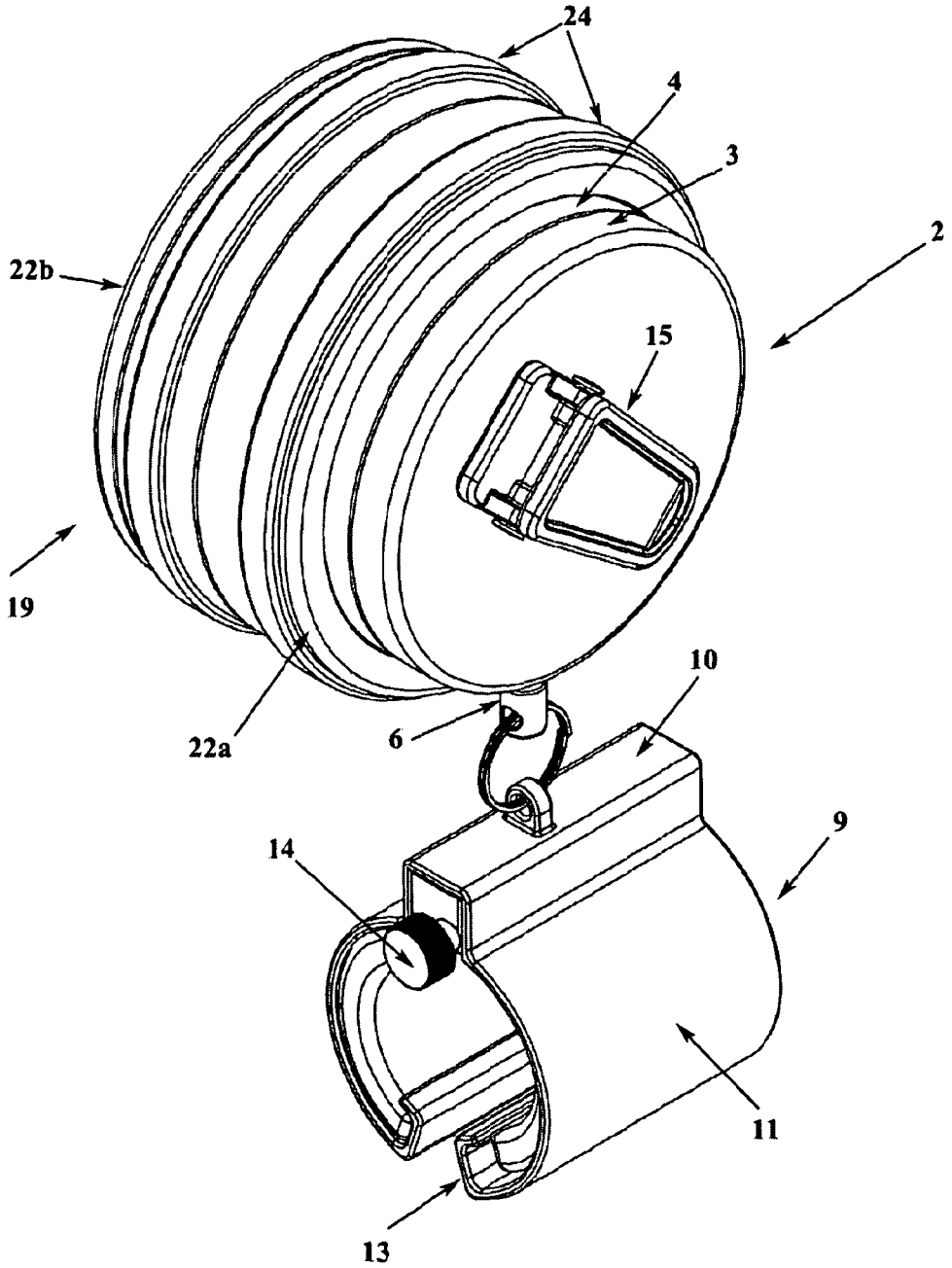
Figure 7A:
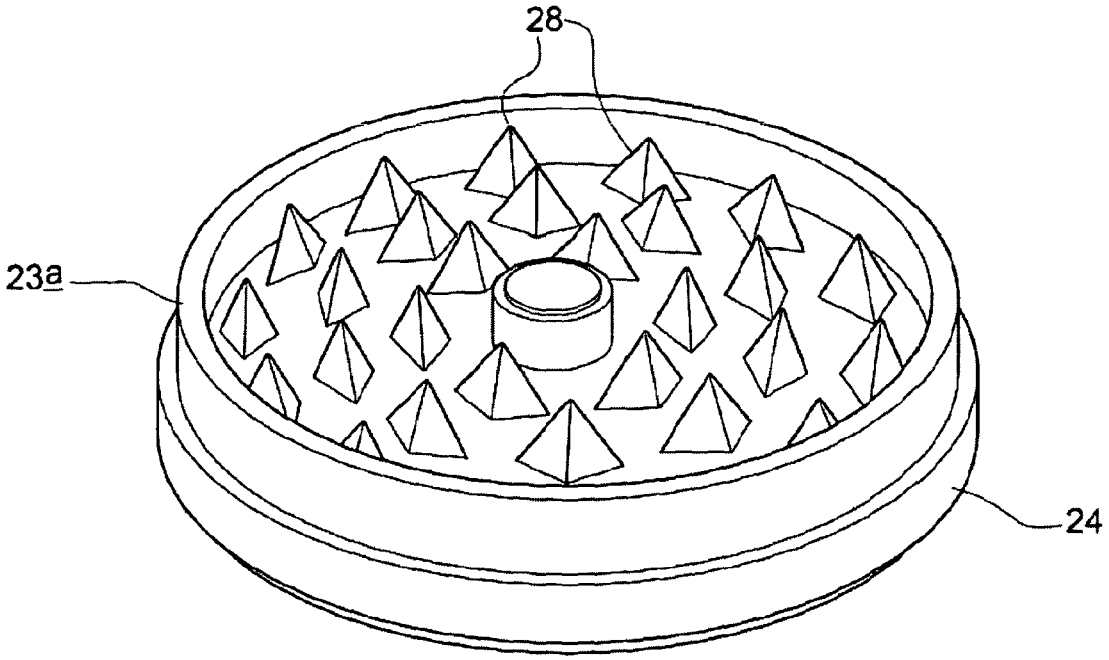
Figure 7B:
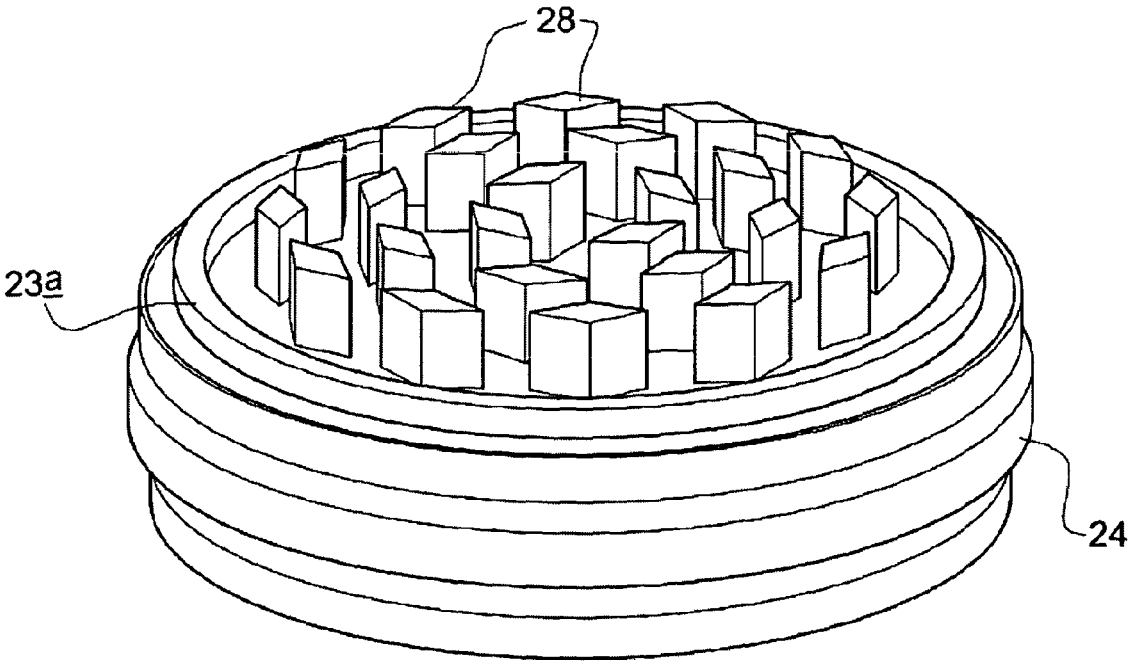

In order that the present invention may be more readily understood, the embodiments will now be described, by way of example, with reference to the accompanying figures, in which:

FIGS. 1 to 3 show a first accessory embodying the present invention;

FIGS. 4*a* to 4*c* show the accessory of FIGS. 1 to 3 gripping different types of lighter;

FIGS. 5 and 6 show a second accessory embodying the present invention; and FIGS. 7*a* and 7*b* show different types of grinding teeth that may be used with the present invention.

Referring firstly to FIGS. 1 to 3, a first embodiment of a smoker's accessory 1 according to the present invention is shown. The accessory 1 comprises a base unit 2, which may take any appropriate form, and in the embodiment is generally rounded in shape and comprises top and bottom elements 3, 4, which are attached together.

A retractable leash 5 protrudes from the base unit 2. In the example shown, the base unit 2 houses a leash mechanism (not shown) that allows the leash 5 to be retracted from, and returned to, the base unit 2. In preferred embodiments the leash 5 is spring-loaded, so that it will retract automatically into the base unit 2.

The leash 5 is preferably a flexible element such as a string or cord, which may be formed, for example, from metal or nylon.

A connector 6 is formed at the free end of the leash 5. The connector 6 is preferably wider than an aperture 7 in the base unit 2 through which the leash 5 protrudes, ensuring that the leash 5 cannot inadvertently be retracted all the way into the base unit 2. In the figures a length of the leash 5 is shown protruding from the base unit 2, but in preferred embodiments the leash 5 will, in its resting state, be retracted fully into the base unit so that the connector 6 rests against the aperture 7. In embodiments a braking mechanism may be provided to slow the retraction of the leash 5, particularly just prior to the connector 6 reaching the aperture 7, to help ensure that the leash 5 does not "snap" back into place in a jarring fashion. For instance, the braking mechanism may comprise a widened covering over the end portion of the leash 5, which may be formed from a soft material such as silicone. A skilled person will understand that other suitable braking mechanisms may be used.

The use of a braking mechanism is particularly advantageous, since the retraction mechanism for the leash 5 must be sufficiently powerful to retract heavy types of lighter (discussed below), and so if the leash is not supporting any lighter at all, or is supporting a relatively light type of lighter, the leash 5 may be retracted very quickly and may harm the user and/or damage the base unit.

In preferred embodiments, a holder in the form of a grip 9 is attached to the connector 6 (via a connecting ring 8 in the depicted embodiment). The grip 9 is adapted to grip and release at least one type of cigarette lighter, and may take a variety of forms.

In the embodiment shown in FIG. 1, the grip 9 comprises an elongate spine 10 with a pair of arms 11 extending therefrom. Each of the arms 11 is curved, and the arms 11 initially extend away from the spine 10 in substantially opposite directions, but curve around towards one another and, at their distal ends 12, have only a relatively small gap between them. When seen end-on, as in FIG. 3, the grip 9 is substantially C-shaped.

The arms need not be curved, and may alternatively be formed with one or more angled bends.

The spine 10 and the arms 11 are all generally elongate, having a length which is roughly equivalent to the width of the base of a standard cigarette lighter, and the grip 9 has a substantially constant cross-section along its length.

At the distal ends 12 of the arms 11, the arms 12 form respective grip surfaces 13 that face generally towards one another. The arms 11 are preferably formed from a resilient material, such as plastic or metal, which can flex to some extent to allow an object to be pushed between the arms 11 and/or grip surfaces 13, and which will then cause the arms 11 and/or grip surfaces 13 to exert an inward gripping force upon the object, thus helping to retain the object in place. A cover, such as a silicone cover, may be formed over all or part of the grip 9 and/or the arms 11.

In the embodiment shown in FIG. 1 the grip 9 includes an adjustment knob 14, which in this example protrudes from one end of the spine 10. The adjustment knob 14 may be grasped by a user and rotated to bring the arms 11 closer to one another, or draw them further apart from one another, thus increasing or decreasing the distance between the grip surfaces 13. For example, the adjustable knob 14 may advance or retract into the spine 10 through being inserted into a threaded aperture, and adjustment of the knob 14 may adjust the tension placed on a spring (not shown) within the spine 10, which in turn exerts a force on one or both of the arms 11, urging the arms 11 away from, or towards, each other. A skilled person will appreciate that there are other ways in which adjustment of the arms 11 may be achieved.

The arrangement of the grip 9 shown in FIG. 1 allows the grip 9 to hold and retain at least three different popular types of standard cigarette lighter as shown in FIGS. 4*a* to 4*c*. Firstly, a standard, slim, disposable cigarette lighter 25 may be gripped, at its base, by the grip surfaces 13 of the arms 11, as shown in FIG. 4*a*.

Secondly, a standard cylindrical-type "clipper"-type lighter 26 may be inserted lengthways into the space between the arms 11 and gripped between the arms 11, as shown in FIG. 4*b*.

Thirdly, if the control knob 14 is manipulated so that the arms 11 are relatively far apart from one another as compared to the situation shown in FIG. 4*a*, then a "Zippo"-type lighter 27 can be gripped, at its base, between the grip surfaces 13 of the arms 11. In each case the arms 11 will deflect to allow the lighter to be inserted, and will then exert a gripping force on the lighter to retain it in place.

It will be appreciated that embodiments of the invention allow a first type of lighter (e.g. a standard disposable lighter) to be held with the longitudinal axis of the lighter arranged in a first orientation with respect to the grip 9, and a second type of lighter (e.g. a clipper-type lighter) with the longitudinal axis of the lighter arranged in a second, different orientation with respect to the grip 9, which is preferably substantially at right-angles to the first orientation.

In preferred embodiments the front of the grip 9 is open, so that a lighter may be inserted into the grip 9 from the front, and also at least one side (and preferably first and second opposing sides) of the grip 9 is open, to allow a lighter to be inserted into the grip 9 from the side. In embodiments where the grip has opposing arms, it is preferred that a lighter can be gripped between ends of the arms when a lighter is inserted Preferably, the grip can hold at least two different types of cigarette lighter. More preferably, the grip can hold at least three different types of cigarette lighter.

Although it will be appreciated that the configuration of the grip 9 described above is particularly advantageous in allowing a smoker to use many different types of lighter with the accessory 1, the grip 9 may take other forms. It is envisaged that the central spine 10 may not be present, and the arms 11 may simply meet at a common central point.

An attachment arrangement is preferably attached to (or formed as part of) the base unit 2, as can be seen in FIGS. 2 and 3, for instance taking the form of a clip 15, which has two opposing jaw members 16, 17, which may move pivotally with respect to one another about a hinge 18, and are biased strongly towards one another. It will be understood that, in use, a user may separate the jaw members 16, 17, place the jaw members either side of his or her belt (or another item of clothing), and allow the jaw members 16, 17 to grip the belt, thus holding the accessory 1 in place.

It will be understood that any other suitable type of attachment arrangement may be used, for instance involving Velcro, one or more magnets, pins and so on.

In preferred embodiments of the invention, the attachment arrangement is mounted rotatably on the base unit 2, so the attachment arrangement may rotate with respect to the base unit 2. In these embodiments it will be understood that, when the accessory 1 is clipped to, for example, a user's belt, the grip 9 will hang generally downwardly from the base unit 2 under the influence of gravity, and the aperture 7 from which the leash 5 protrudes from the base unit 2 will point generally downwardly. When a user grasps the lighter, however, and pulls the lighter upwardly in order to use the lighter, the base unit 2 will rotate with respect to the attachment arrangement, so that the aperture 7 from which the leash 5 protrudes from the base 3 points generally upwardly.

In embodiments of the invention, the base unit may be provided in two parts, a first one of which does not rotate with respect to the attachment arrangement, and a second one from which the leash 5 protrudes, with the first and second parts being rotatable with respect to one another. Ultimately, it is important that the part of the base unit from which the leash 5 protrudes is rotatable with respect to the attachment arrangement, and the skilled person will realise that there are several ways in which this may be achieved.

This makes the accessory 1 generally more convenient to use. If the base unit 2 is connected to the attachment arrangement in a fixed, non-rotatable fashion, then when the user grasps a lighter held by the grip 9 and pulls the lighter upwardly, the leash 5 will be forced to turn through a tight corner at the point where it protrudes from the aperture 7 in the base unit 2. This leads to excessive friction, and wear on the leash 5, and it has been found that the leash 5 may even "stick" at the point where it protrudes from the aperture 7 in the base unit 2. If the user pulls forcefully on the lighter, this may even cause the base unit 2 to become completely detached from the user's clothing, and this could cause the device 1 to become lost or damaged.

In other embodiments, the base unit 2 may include a container, which encloses an internal space, and in these embodiments the top and bottom elements 3, 4 may comprise a base 3 and lid 4. The base 3 and lid 4 may attach by any appropriate means (e.g. by a snap-fit or screw thread) in order to enclose the internal space. The internal space may, for example, be used to store herbs, cigarette papers, filters and the like. The base unit 2 may have a separate compartment, distinct from the main internal space formed between the base 3 and the lid 4, which houses the leash mechanism.

Turning to FIGS. 5 and 6, a further embodiment is shown. In this embodiment a further device 1*a* is presented, which has components as described above. However, attached to the base unit 2 is a grinder 19. The grinder 19 comprises lower and upper elements 20, 21, each of which generally takes the form of a shallow cup having a base 22A, 22B and a generally circular upstanding side-wall, 23A, 23B. The upper and lower elements 20, 21 may be attached releasably to one another, for instance by cooperating magnets, or through the ends of the side-walls 23A, 23B carrying cooperating screw threads, allowing the upper and lower elements 20, 21 to be fitted together to enclose an internal space. In preferred embodiments, when the upper and lower elements 20, 21 are fitted together they may be moved rotatably with respect to one another.

Running around the outer circumference of the side-walls, 23A, 23B of the lower and upper elements 20, 21 are respective gripping strips 24, which are preferably formed from a material which is relatively easy for the user to grip with his or her fingertips, such as silicone or rubber. Other types of gripping arrangements are envisaged, such as series of shorter rubber strips or studs, and it is not necessary to have gripping strips that extend in an unbroken fashion all of the way around the side walls.

Provided on the inner surfaces of the base 22A, 22B and upper elements 20, 21 are respective sets of grinding teeth (not shown), which may take any suitable form. For example, the grinding teeth 28 may take a pointed, pyramidal form, as shown in FIG. 7*a*, or a trapezoid prismic form, as shown in FIG. 7*b*. It will be appreciated that other types of grinding arrangements may also be used.

In use, the lower and upper elements 20, 21 of the grinder 19 may be separated from one another, and a quantity of a herb (or another substance) may be placed on the internal surface of the base 22A, 22B of one of the elements 20, 21. The elements 20, 21 may then be fitted together so that the quantity of herb is contained in the internal space defined by the enclosed grinder 19.

A user may then grip the respective gripping strips 24 with his or her hands, and rotate the lower and upper elements 20, 21 with respect to one another in a reciprocating action. It will be understood that the quantity of the herb inside the grinder 19 will be ground and masticated by the grinding teeth 28, thus preparing the herb for inclusion in a cigarette.

Any known type of grinder may be included as part of the present invention. For instance, one type of grinder includes a mesh, through which ground pieces or crystals of herb may pass after grinding into a separate collection compartment. A skilled person will be aware of various different designs of grinder.

In the embodiment shown in FIGS. 5 and 6, the grinder 19 includes a second internal space, formed between the base 22*b* of the upper element 21 and a further lid 29, which is attached to the upper element 21 in any suitable way, for instance through cooperating screw threads. The second internal space may be used to store items such as tobacco or cigarette papers, so that these items will not be affected during a grinding procedure. This may be provided instead of, or as well as, a container being formed as part of the base unit 2, as described above.

The grinder 19 is attached to the base unit 2, preferably in a releasable fashion. For instance, corresponding magnets (not shown) may be provided on a part of the base unit 2 and on a part of the grinder 19 (for instance, on the outer surface of the base 22A of the lower element 20). Any other suitable attachment method may also be used, for example screw threads or clips. It will be understood that the use of a braking mechanism for the retraction mechanism for the leash 5 will be particularly advantageous if the grinder 19 is attached releasably to the base unit 2, as the leash 5 may dislodge the grinder 19 from the base unit 2 if it snaps back forcefully.

Therefore, it will be understood that the second device 1*a* allows a smoker to store his/her smoking products and have immediate access to a lighter and grinder, in a compact, practical unit.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A device comprising:

a base unit;

an attachment means, connected to the base unit, which can be used to attach the base unit releasably to a user's clothing;

a leash arrangement comprising a flexible leash element which may be extended from, and retracted into, the base unit; and a holder attached to the leash element, the holder being operable to grip and release at least one type of cigarette lighter;

wherein the holder comprises first and second arms which protrude away from a central point and are deflected towards one another to present generally opposed gripping surfaces;

the arms are formed from a resilient material, allowing the arms to deflect to allow a cigarette lighter to be placed between the arms, so the arms will then exert a gripping force on the lighter; and an adjustment arrangement is provided to be grasped and rotated by a user to bring the arms closer to one another or draw them further apart from one another thus increasing or decreasing the distance between the gripping surfaces when the holder is in an undisturbed state.

2. A device according to claim 1, wherein the attachment means is attached rotatably with respect to a part of the base unit from which the leash protrudes, so that, if the attachment means is attached to a part of a user's clothing, the part of the base unit may rotate with respect to that part of the user's clothing.

3. A device according to claim 1, wherein the central point comprises a central spine from which the arms protrude.

4. A device according to claim 1, wherein the adjustment arrangement is an adjustment knob which can be rotated by a user.

5. A device according to claim 1 further comprising a grinder, the grinder enclosing a first internal space into which a quantity of a herb can be placed, and have respective first and second grinding arrangements which protrude inwardly into the first internal space, and having a grip arrangement which may be gripped and manipulated by a user so that the sets of grinding arrangements move with respect to one another to apply a grinding action to a quantity of the herb received in the first internal space.

6. A device according to claim 5, wherein one or both of the grinding arrangements is a set of grinding teeth.

7. A device according to claim 5, wherein the grinder is releasably attachable to the base unit.

8. A device according to claim 7, wherein the grinder is releasably attached to the base unit by way of respective first and second magnets.

9. A device according to claim 5, wherein the grinder comprises two elements which may rotate with respect to one another, and the grip arrangement comprises respective gripping arrangements formed on outer surface of the two elements.

10. A device according to claim 5, wherein the grinder comprises a second internal space, separate from the first internal space, and can be opened to gain access to the second internal space.

11. A device according to claim 10 wherein the sets of grinding arrangements do not protrude into the second internal space.

12. A device according to claim 1, wherein the base unit comprises, or is attached to, a container which substantially encloses an internal space, and can be opened to gain access to the internal space.

13. A device according to claim 1, further comprising a braking mechanism to slow the retraction of the leash into the base unit.

14. A device according to claim 13, wherein the braking mechanism slows the retraction of the leash into the base unit when a distal end of the leash nears the base unit.

15. A device according to claim 13, wherein the braking mechanism comprises a covering applied over at least a part of the leash.

16. A device comprising:

a base unit;

an attachment means, connected to the base unit, which can be used to attach the base unit releasably to a user's clothing;

wherein the attachment means is attached rotatably with respect to a part of the base unit from which the leash protrudes, so that, if the attachment means is attached to a part of a user's clothing, the part of the base unit may rotate with respect to that part of the user's clothing;

a leash arrangement comprising a flexible leash element which may be extended from, and retracted into, the base unit;

a holder attached to the leash element, the holder being operable to grip and release at least one type of cigarette lighter; and a grinder, the grinder enclosing a first internal space into which a quantity of a herb can be placed, and have respective first and second grinding arrangements which protrude inwardly into the first internal space, and having a grip arrangement which may be gripped and manipulated by a user so that the sets of grinding arrangements move with respect to one another to apply a grinding action to a quantity of the herb received in the first internal space;

wherein the grinder comprises a second internal space, separate from the first internal space, and can be opened to gain access to the second internal space.

* * * * *